US007793932B1

(12) United States Patent
Bartman

(10) Patent No.: US 7,793,932 B1
(45) Date of Patent: Sep. 14, 2010

(54) WIRE STACKER TRAY WITH MOVABLE BANDS OR SPRINGS

(75) Inventor: David Alan Bartman, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/465,926

(22) Filed: May 14, 2009

(51) Int. Cl.
*B65H 31/20* (2006.01)

(52) U.S. Cl. ..... 271/224; 271/219; 271/209; 271/213; 271/223

(58) Field of Classification Search ..... 271/207, 271/209, 213, 223, 224
See application file for complete search history.

(56) References Cited

U.S. PATENT DOCUMENTS 4,364,553 A * 12/1982 Wilson ..... 271/219
5,110,111 A * 5/1992 Gompertz et al. ..... 271/213
6,183,406 B1 * 2/2001 Barrus et al. ..... 101/228

* cited by examiner

*Primary Examiner*—Gene Crawford
*Assistant Examiner*—Gerald W McClain
(74) *Attorney, Agent, or Firm*—James J. Ralabate

(57) ABSTRACT

The present invention provides a paper collecting tray that reduces or eliminates paper curling. The collecting tray has a wire structure using springs or movable bands to support various size papers. These springs are provided in one embodiment to support paper sheets having 8.5 inch widths, 24 inch widths and 36 inch widths. These are configured to provide substantial support for the sheets and configured to prevent paper curling when the paper is passed to the collecting tray.

2 Claims, 10 Drawing Sheets

WIRE STACKER TRAY WITH MOVABLE BANDS OR SPRINGS

This invention relates to electrophotographic marking systems and, more specifically, to paper stacker trays used in such systems.

BACKGROUND

While the present invention can be effectively used in a plurality of non-marking paper-handling apparatus or marking systems such as ink jet printing, non-xerographic printing, etc., it will be described for clarity as used in stacking trays or modules of electrostatic marking systems such as Electrophotography. In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive area. This image may be subsequently transferred or marked onto a support surface such as copy paper to which it may be permanently affixed by heating or by the application of pressure. Following transfer of the toner image or marking, the copy paper may be removed from the system by a user or may be automatically forwarded to a finishing station where the copies may be collected, compiled and stapled and formed into books, pamphlets or other sets. This invention will be described throughout in reference to collection stations both before and after finishing stations. It should be understood, however, that the present invention can be used in any systems where paper is collected in paper stacks.

As above noted, there are many marking systems that transport paper or other media after the paper is marked in marking step or steps. These marking systems could include ink jet printing, electrostatic marking systems, non-electrostatic marking systems and printers or any other system where paper or other flexible media or receiving sheets are transported internally to an output device such as stacking trays or a finisher and compiler station or stations and the subsequent stacking of paper after the compiler completes its functions. As above noted, the stacking tray of this invention can be used both before and after finishing stations.

These electrostatic marking systems have finisher and compilers located at a site after the receiving sheets (paper) have been marked with a toner. After finishing is completed, the paper is conveyed to a paper-stacking device generally conveniently located at a bottom portion of the finisher module of a marking machine. A stacking cart generally used is movable so that it can be moved into and out of the finisher module when loaded with paper. Current prior art paper stacking involves the use of carts on casters for compiling paper stacks in printers. Once the carts are loaded, a manual process of unloading stacks from the main stack is generally followed.

Current prior art wide format stacking trays with a capacity of more than 100 sheets generally do not stack properly. The current prior art stackers generally use a deep tray and paper curl is induced by the printer which does not allow the prints to stack flat. They curl under because the deep tray does not contribute enough support or guidance over the initial tray depth. Paper curl can cause poor registration, sheet damage, jamming or image quality, both before and during finishing.

Various means have been suggested in the prior art to control the degree of curl and flatness of papers stacked in the paper stack. This is important since sheet curl causes problems of handling as the sheet is processed in the feeding, printing or finishing module. Sheets delivered in a curled condition have a tendency to have their edges out of registration with the aligning mechanisms and other sheet-moving systems employed in the printing machine. In addition, curled sheets tend to frequently produce jams or misfeeds within the feeding and printing modules and especially within output sorting, stacking, collating, compiling and/or other sheet-handling systems.

SUMMARY

This invention addresses the problem with a cost effective stacking system which consistently supports the paper as it enters the stacking tray. A difference from prior art systems is the present stacking tray's ability to handle different widths of paper varying from 8.5"-36" or greater without the need to adjust the supporting force. The stacking system of this invention uses, in one embodiment, six independent "diving boards" springs, or movable bands spaced strategically to handle common media widths.

Generally, the stacking tray of this invention can use at least two (2) springs or movable bands up to any suitable number of movable bands depending upon the sizes of paper being collected and stacked. For example, a two-band assembly could be used for only 8.5" (or similar size) paper. A four (4) band assembly could be used for only 24" paper and a six (6) band assembly could be used when only 36" paper or a mixture including 36" paper is being collected and stacked.

An assembly using six (6) bands is used in one embodiment to collect papers having widths of 8.5", 24" and 36". Thus, at least two movable bands or springs up to any suitable number of bands to support the sizes of paper can be used in the present invention. A system using six (6) bands or springs is preferred because it encompasses and can accommodate most size paper used in an Electrophotographic marking apparatus.

It is important that flexible bands or springs be used that will support the edges of various paper sizes in order to correct or minimize paper curling in the stack. When a six-band or spring assembly is used and various size paper is being fed therein, the middle two springs support the 8.5" paper. The inner four springs support the 24" paper and the entire six springs support the 36" paper, thus preventing or significantly reducing edge curl in the papers stacked. As stated above, at least two (2) bands or springs are used in this invention, up to any number of bands needed to support the paper sizes being collected and stacked. An assembly of six (6) bands or springs is preferred because this assembly can accommodate most sizes of paper.

Therefore, this invention provides a means to address stack quality issues in wide format stackers that result when output curl is unsupported as it is delivered to an output tray. Currently, some prior art stackers can induce sheet damage due to the large distance that the sheet travels unsupported in the output tray prior to contacting the tray itself. The stacker system of this invention uses, in one preferred embodiment, six independent springs or bands along the width of a wide format stacking tray. Each spring is calculated to support a section of paper stacked on it. Its spring rate allows each section to support the paper on it and be progressively depressed so that the top sheet maintains a paper stack height that supports each sheet as it enters the stacking tray. By being independent of each other, varying width paper can be supported by the appropriate spring beneath it and curling is reduced significantly.

DETAILED DISCUSSION OF THE DRAWINGS AND PREFERRED EMBODIMENTS

Figure 1:
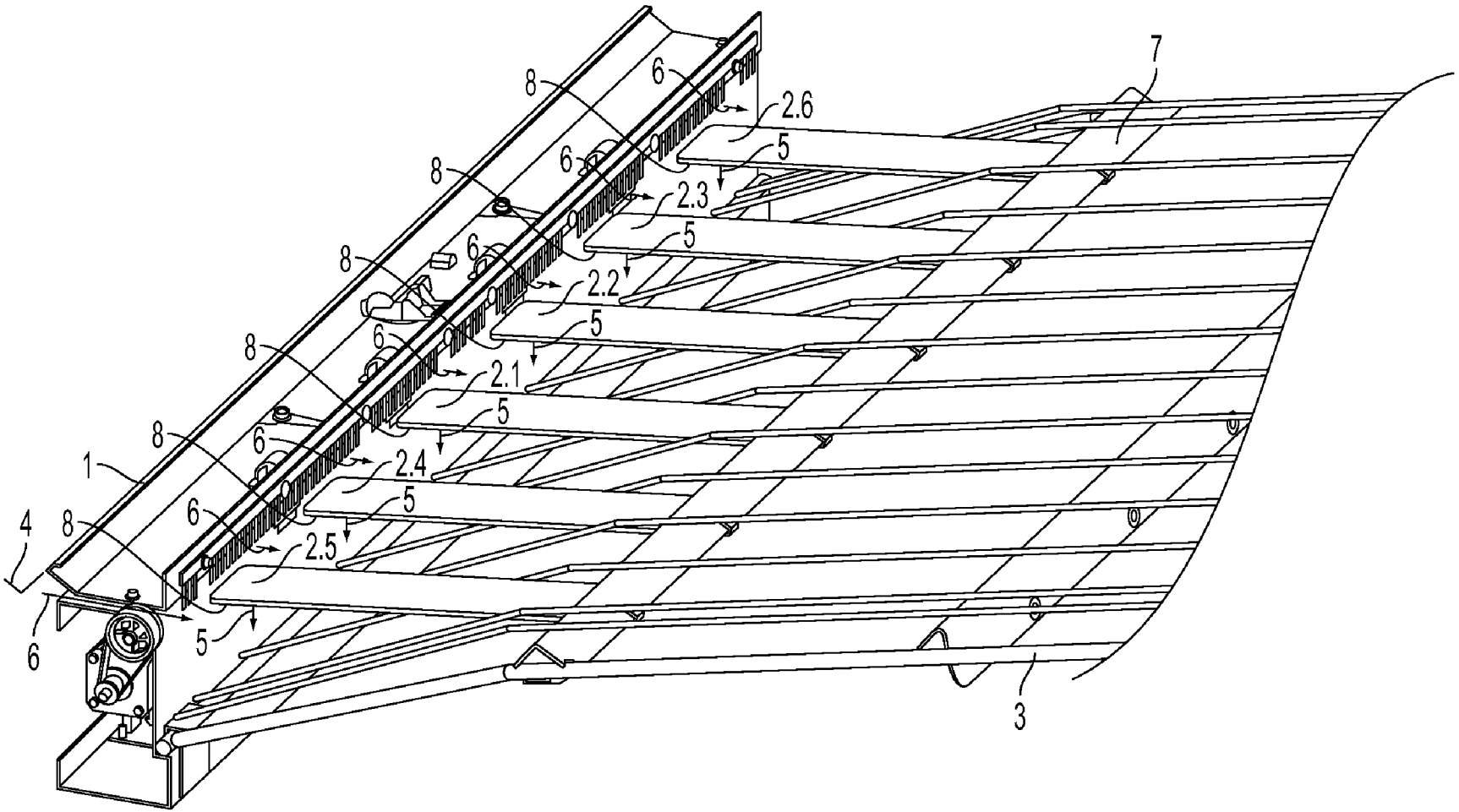
FIG. 1 illustrates a top perspective view of an embodiment of this invention where a six movable band or spring assembly is used.

In FIG. 1, an embodiment of the stacking assembly 1 of this invention is illustrated from a top perspective view. Springs or movable bands 2.1 to 2.6 are positioned in alignment along the width of a wide format stacking tray 3. The assembly 1 uses six independent springs along the width of a wide format-stacking tray. Each spring 2 is calculated to support a section of paper 4 stacked on it. Its spring rate allows each section to support the paper 4 on it and be progressively depressed in the direction of arrows 5 so that the top sheet maintains a paper stack height that supports each sheet 4 as it enters the stacking tray 3. By being independent of each other, varying width paper can be supported by the appropriate spring 2 beneath it.

Benefits of the assembly 1 of this invention include allowance of varying width paper (8.5"-36") to be stacked. Also prior art printers induce paper curl as unsupported paper tends to curl under and stack improperly. Prior art stackers do not function due to the deep valley that paper 4 has to traverse. This allows each print to be supported evenly regardless of the varying widths being produced by the wide format printer. The paper 4 enters the assembly 1 at locations of arrow 6 and as paper 4 contacts springs 2 (2.1-2.6), the springs 2 (2.1-2.6) are depressed downwardly in the direction shown by arrows 5. 8.5 inch papers 4 will contact and be supported by springs 2.1 and 2.2. 24 inch width papers will be supported by springs 2.1, 2.2, 2.3 and 2.4 and 36" papers will be supported and stacked on springs (or movable bands) 2.1, 2.2, 2.3, 2.4, 2.5 and 2.6. Each spring 2 (2.1-2.6) is connected to and supported by spring support 7 at one end and extending to spring flexible ends portions and ends 8. Springs 2 can be made from flexible metals, flexible plastics or any other suitable spring-providing material.

By "wider paper" is meant throughout this disclosure and claims, paper having a width of 36" or greater. By "narrower paper" is meant through this disclosure and claims, paper less than 36" in width such as 8.5"-24".

Figure 2:
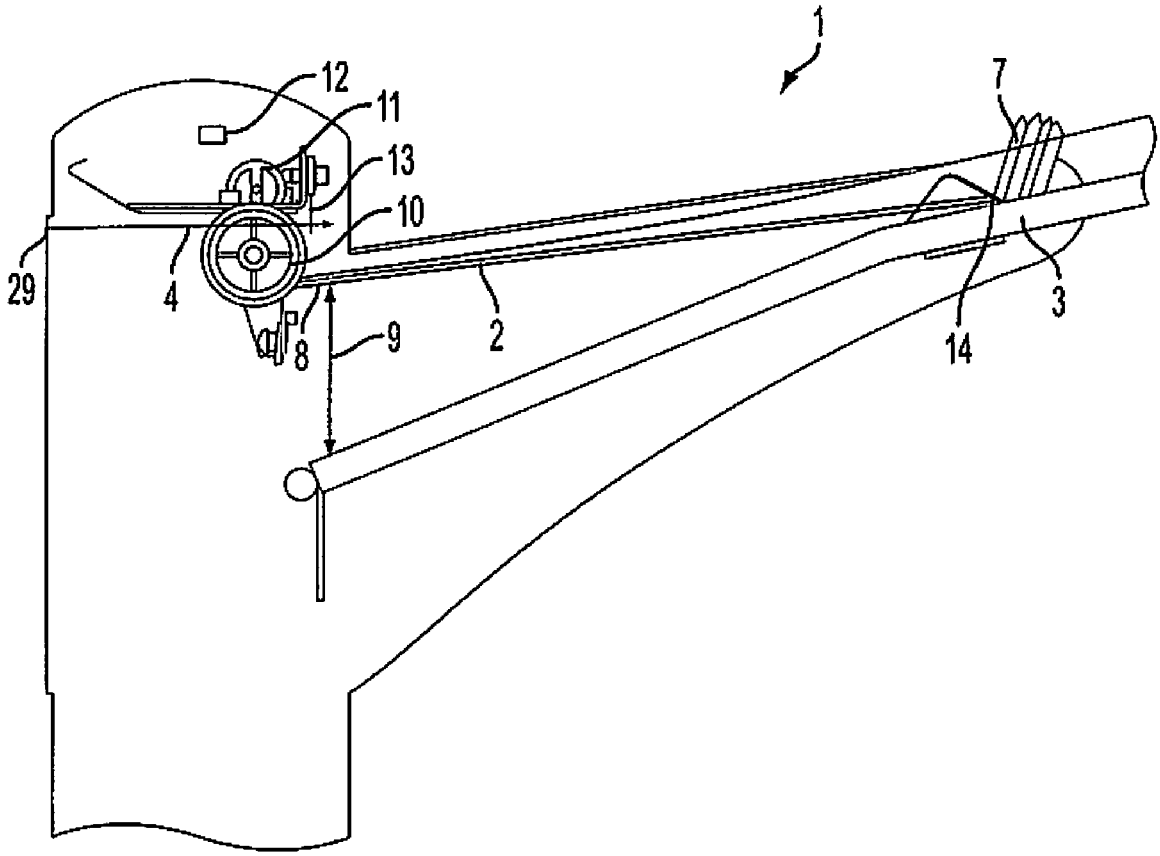
FIG. 2 illustrates a side view of one embodiment of the stacking assembly of this invention.

In FIG. 2, a side line view of an embodiment of the stacking assembly 1 of this invention as shown as paper 4 passes between drive roller and idler roller 11 to enter the stacking assembly 1. Once paper 4 passes drive roller 10 and idler roller 11, it falls on movable bands or springs 2 which subsequently depress the springs 2 downwardly to the tray depth 9 where the paper is supported by the springs 2 and the wire stacking tray 3. A sensor 12 can be placed at the paper entrance to sense and control the flow of paper 4 in the stacking assembly 1. The sensor 12 is connected to a controller (not shown) that controls the paper flow. A static brush 13 is used to control any static generated by paper in the system. Springs 2 are attached at their fixed end 14 to spring support 7 allowing the remainder of springs or movable bands 2. The stacking tray including preferred wire stacking tray 3 can be made of any suitable metal, plastic or other suitable materials. However, the stacking tray 3 can be made from a solid not wire configuration if suitable provided that springs 2 are free to function the same as described herein including ability to move or flex downward. Therefore a "stacking tray" as used throughout this disclosure is intended to include both the preferred wire and also solid stacking trays.

Figure 3:
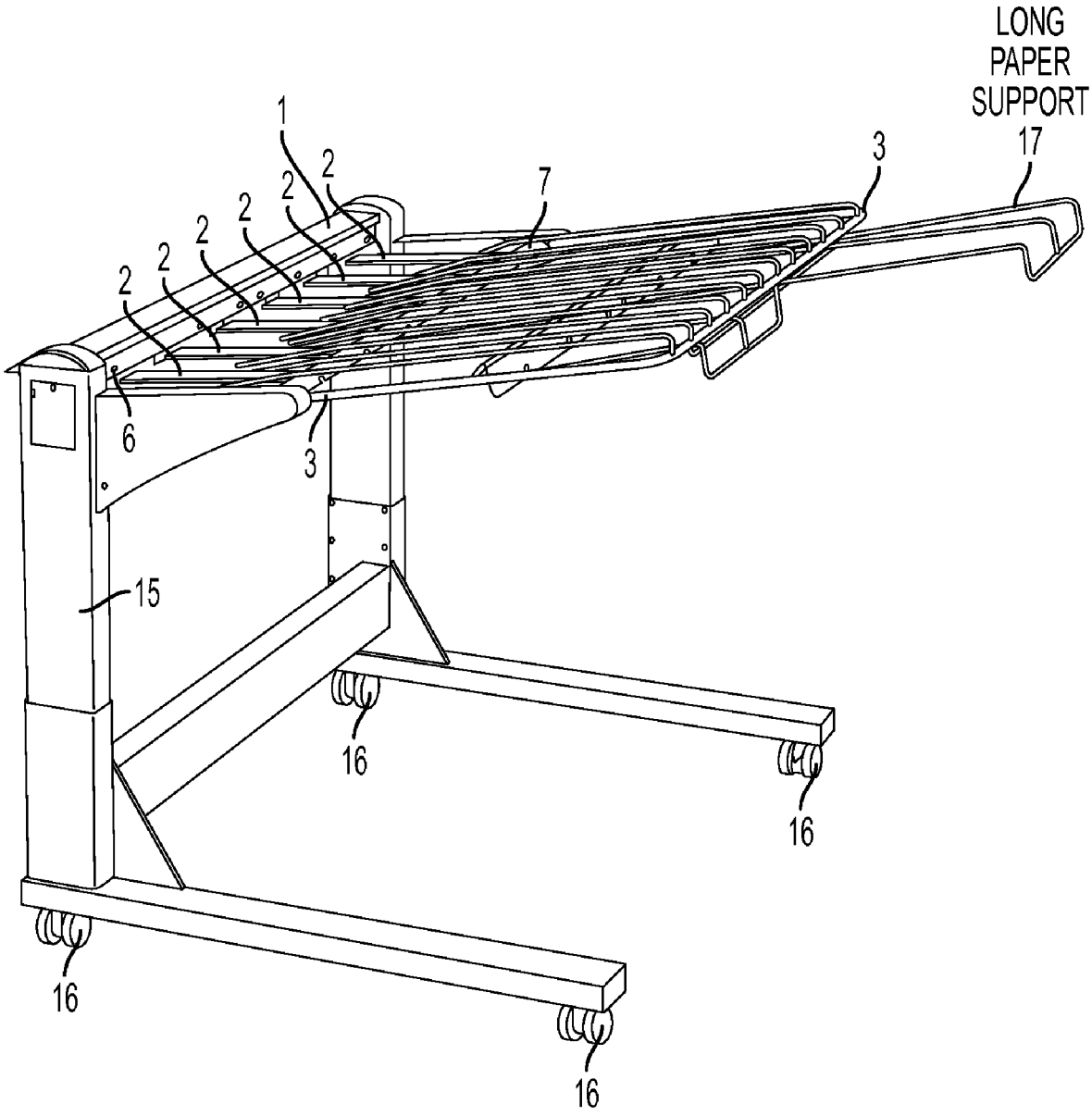
FIG. 3 illustrates a perspective view of a movable embodiment of the stacking assembly of this invention.

In FIG. 3, a side perspective view of stacking assembly 1 is shown as it is attached to a movable frame 15 having wheels 16 for easy manual movement of the paper entrance 6 into assembly 1. The wire stacking tray 3 is shown as it is attached to the top of frame 15. Springs or movable bands 2.1-2.6 are shown at 2 and attached to spring support 7. The wire stacking tray 3 may be moved into and out of a paper collection module of a marking system (or any other paper-handling system or apparatus.

A paper support 17 is movably attached to wire stacking tray 3 to accommodate longer paper collected.

Figure 4:
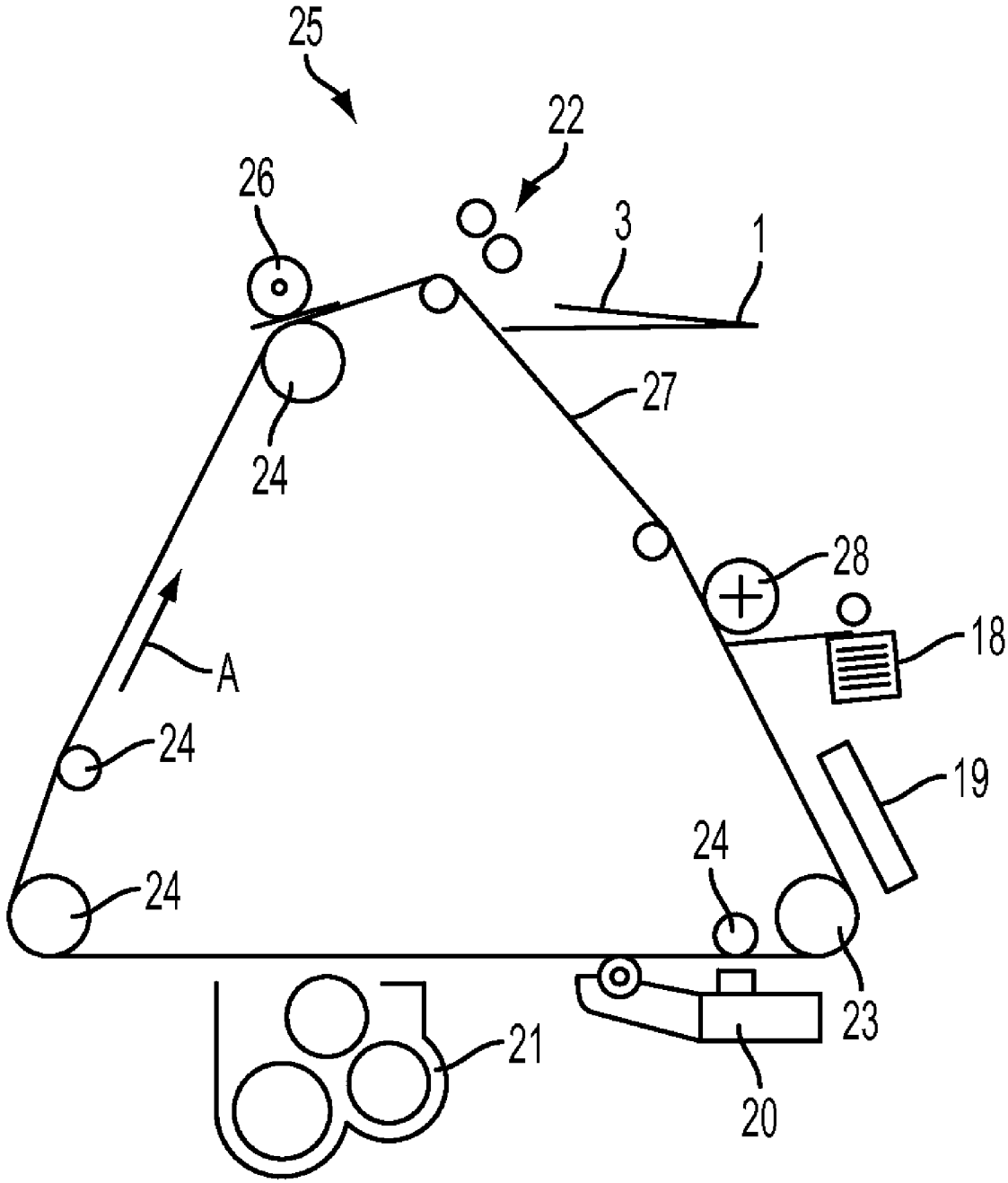
FIG. 4 illustrates a xerographic marking system using the stacking assembly of this invention.

In FIG. 4 a typical electrophotographic or xerographic monochrome marking system 25 is illustrated having the "conventional xerographic" stations, i.e. paper feed station 18, charging station 19, exposure station 20, developer station 21, fusing station 22, transfer station 26, cleaning station 28, and collection station 1 with wire stacking tray 3. The motor 23 drives the photoconductive belt 27 around rollers 24 through each station as indicated by the direction arrows. The paper sheet collection station 1 is configured to accept various size imaged paper.

Figure 5:
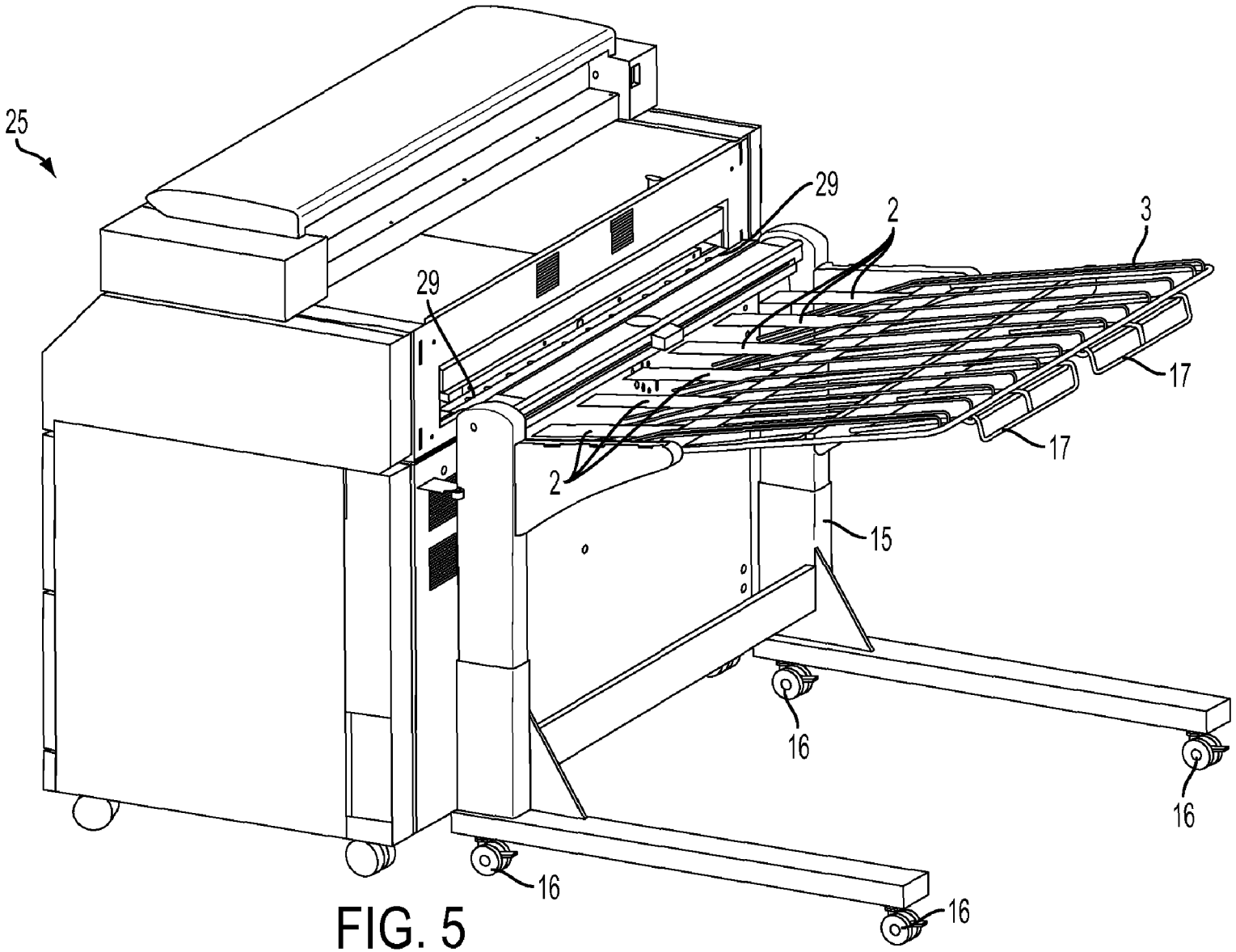
In FIG. 5, a perspective view of an embodiment of the stacker assembly is illustrated as it is operationally connected to a xerographic printing or marking system so as to collect imaged paper from the marking system.

Of course, the wire stacker tray 3 can be used in any color marking system or other paper handling systems as noted above. The monochrome marking system of FIGS. 4 and 5 are shown for clarity only and not limitation.

We used and tested prior art stacking trays and compared the results with using the stacking trays of this invention. In the prior art test, we found that 100% of the widths 8.5", 24" and 36" paper collected had curls.

In the test using the stacking tray of the present invention, 0% of the 8.5", 24" and 36" paper collected had curls.

We used the same conditions, times, paper, paper sizes, and printer in both above tests.

Figure 6:
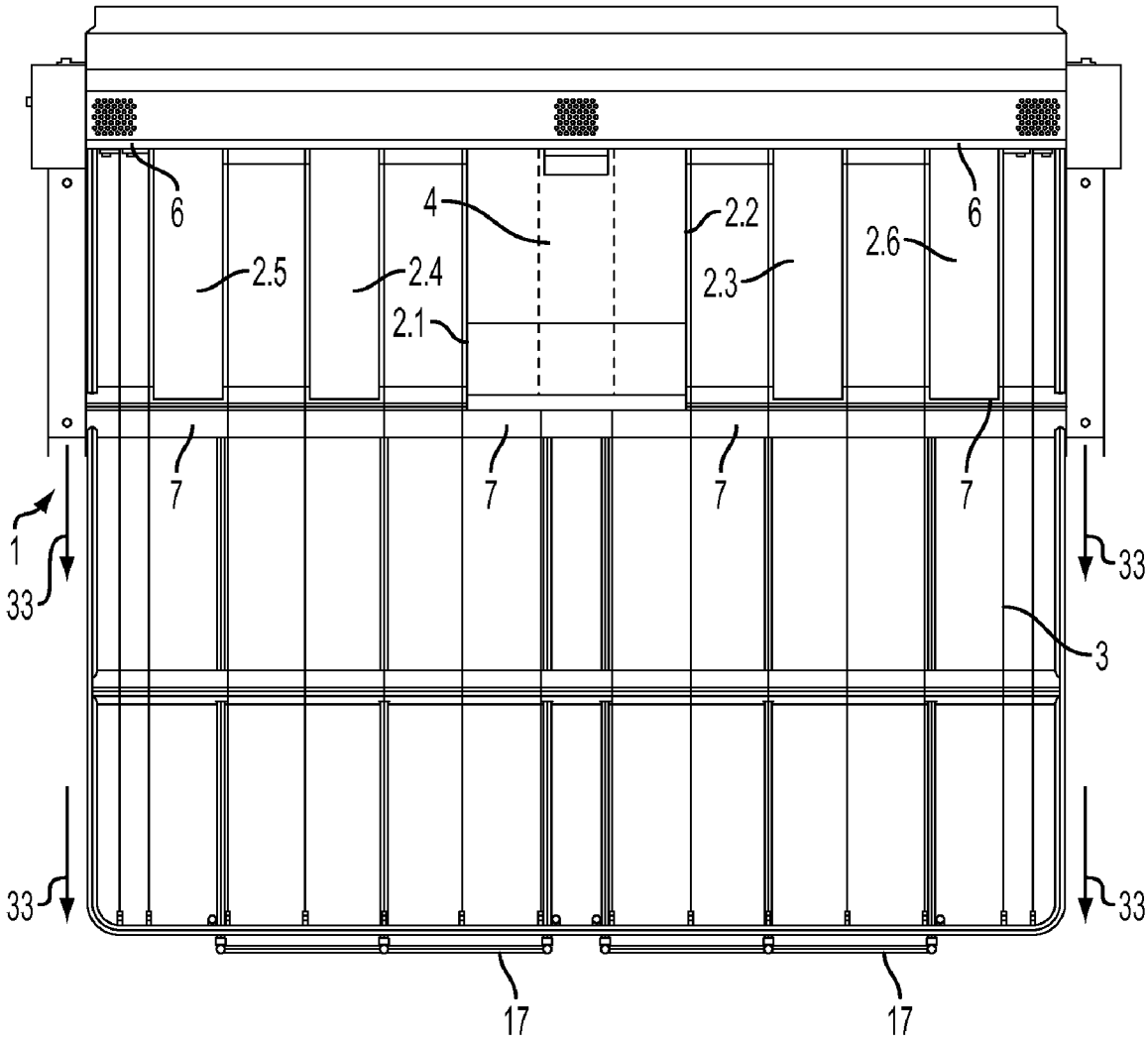
In FIG. 6, a top plan view of an embodiment of the wire stacker assembly of this invention is illustrated as it collects a stack of 8.5" width paper.

In FIG. 5, the xerographic printer 25 of FIG. 4 is shown as it works together with the stacking assembly 1 of this invention. The movable stacking assembly is moved so that its paper entrance 6 is aligned with the printer paper outlet 29. Once the paper sheet 4 leaves the printer 25, it slides along springs or bands 2 (2.1-2.6) and the paper including the edges of paper 4 are supported by the springs 2. The preferred wire stacking tray 3 is shown as it is attached to the top of movable frame 15. The springs 2 act as paper supports for different size paper. For example, in the top view of wire stacking tray 3 shown in FIG. 6, a paper 4 having a size of 8.5"×11" is shown being supported by springs 2.1 and 2.2 so if only 8.5" width paper is going to be collected, only two springs 2.1 and 2.2 are needed in the wire stacking tray 3 of this invention. Six springs 2 are shown in FIG. 6 only for clarity. The four outside springs 2.3, 2.4, 2.5 and 2.6 can be eliminated when only 8.5" width paper is involved and collected.

In FIG. 6, the wire portion or area below spring support 7 (as indicated by arrows 33) can be a solid rather than wire configuration if suitable. Thus, the wire portions of stacking tray 3 can be solid except for the area surrounding springs 2.1-2.6. Wire is preferred, however, because of weight, ease of use, flexibility, etc.

Figure 7:
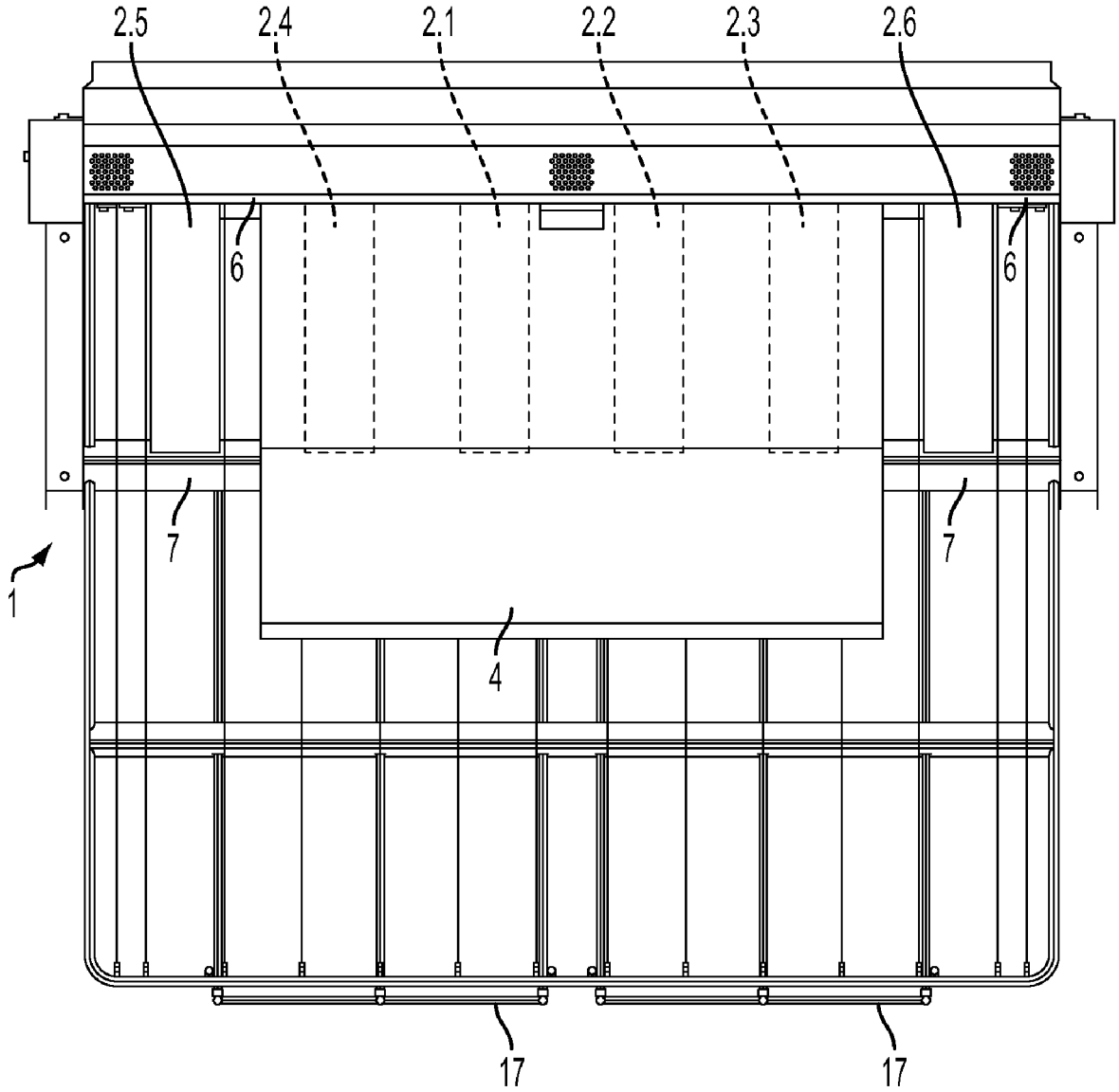
FIG. 7 illustrates a top plan view of an embodiment where 24" width paper is collected and stacked.

In FIG. 7, a top view of the wire stacking tray 3 is shown where tray 3 is accepting and supporting paper 4 having a paper size of 24"×18". Here, only four springs 2 are needed to support the paper 4 and prevent curling. Again, six springs 2 are shown for clarity. However, the two outer springs 2.5 and 2.6 are not needed when only 8.5" and 24" width papers are collected. Thus, this FIG. 7 could be viewed as having only four springs 2.1 to 2.4. When 36" width paper is collected, all springs 2.1-2.6 are covered by the paper corresponding to FIG. 6 where two springs 2.1 and 2.2 are covered when 8.5" width paper is used and in FIG. 7 where four springs are covered by 24" width paper, i.e. springs 2.1-2.4. See FIG. 10 which illustrates a stack of 36" width paper which covers all of springs 2.

Figure 8:
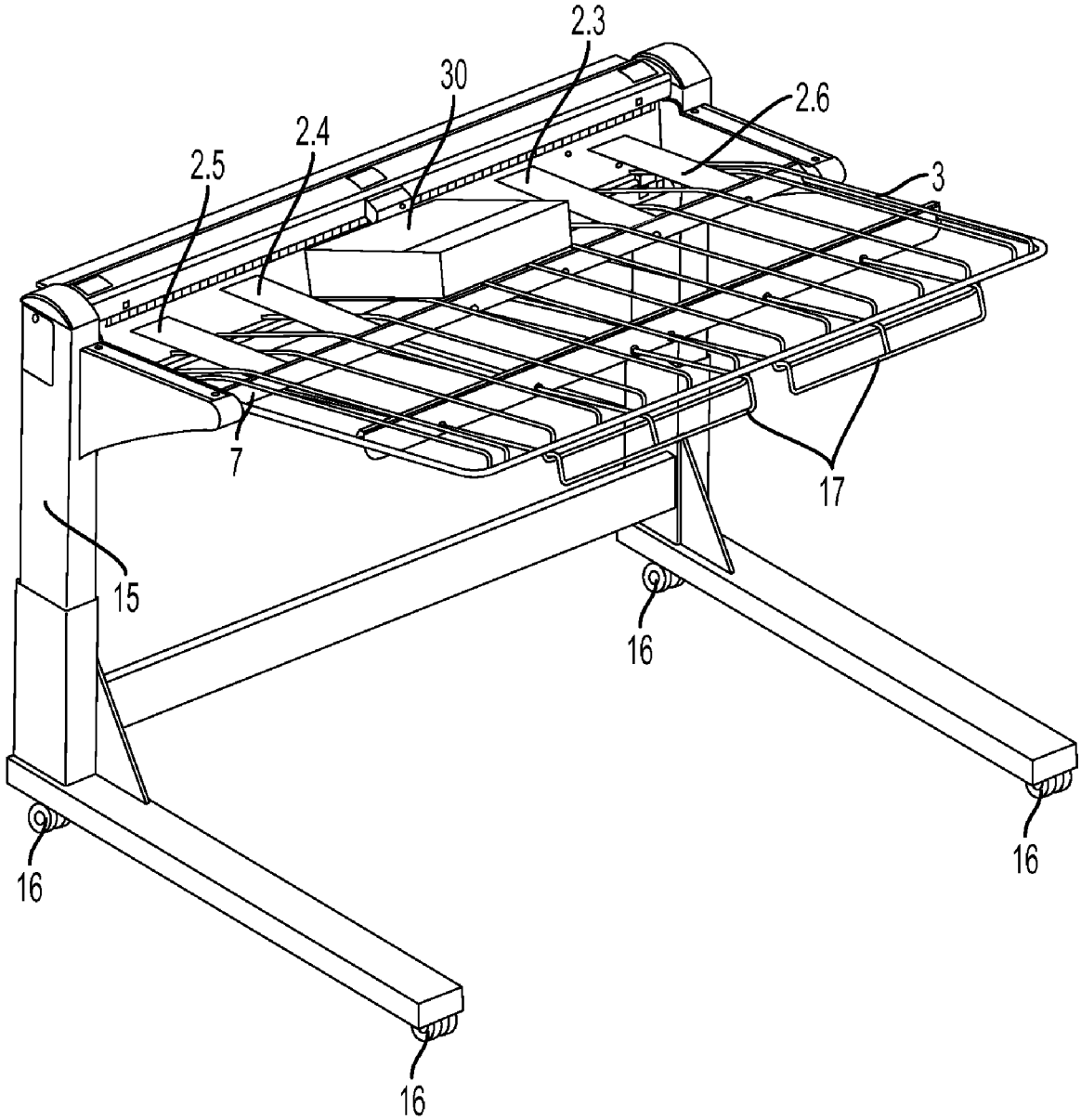
FIG. 8 is a perspective view of a movable embodiment of this invention as it collects and supports a stack of 8.5" width paper.
Figure 9:
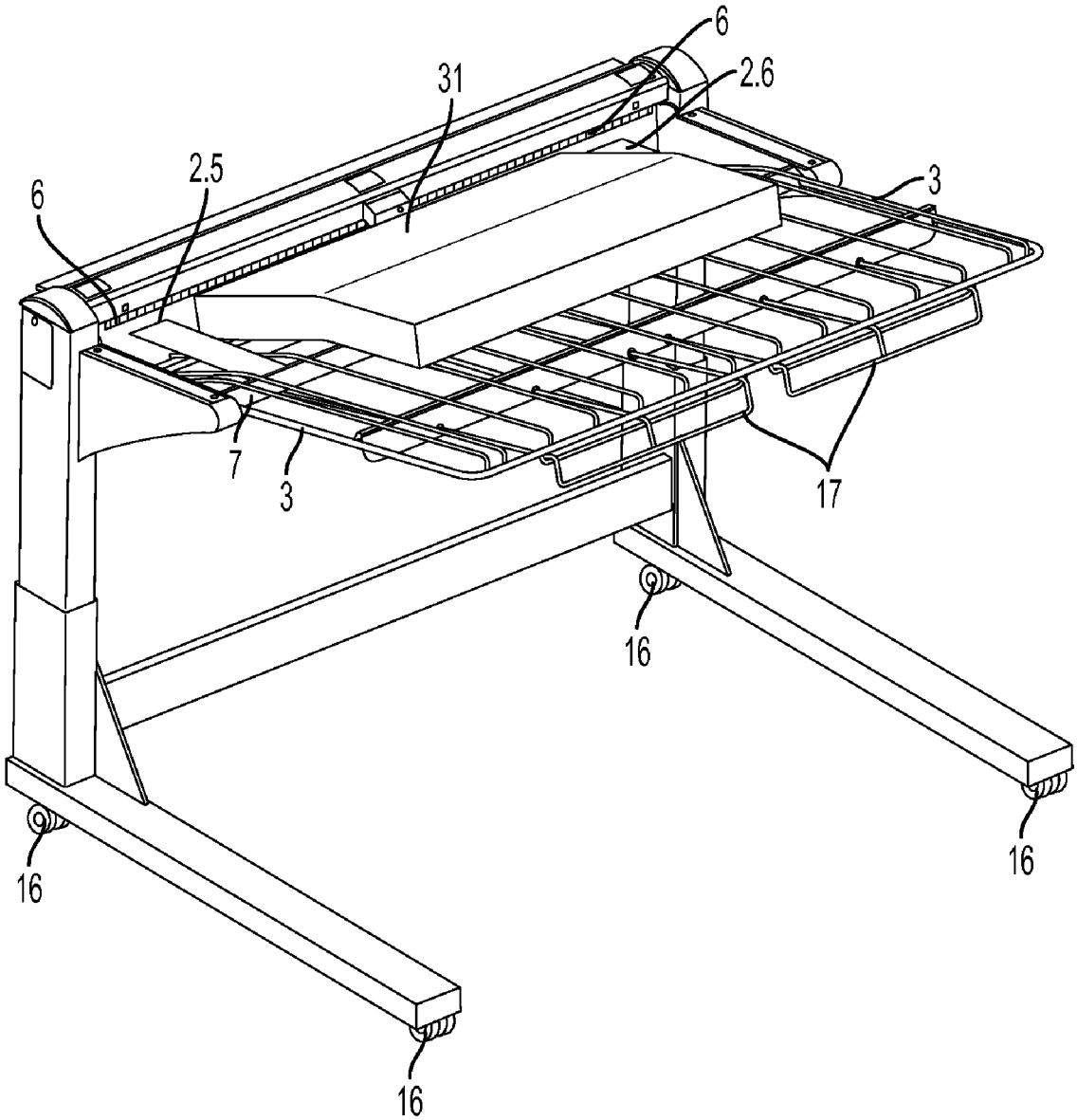
FIG. 9 is a perspective view of a movable embodiment of this invention as it collects and supports a stack of 24" width paper.
Figure 10:
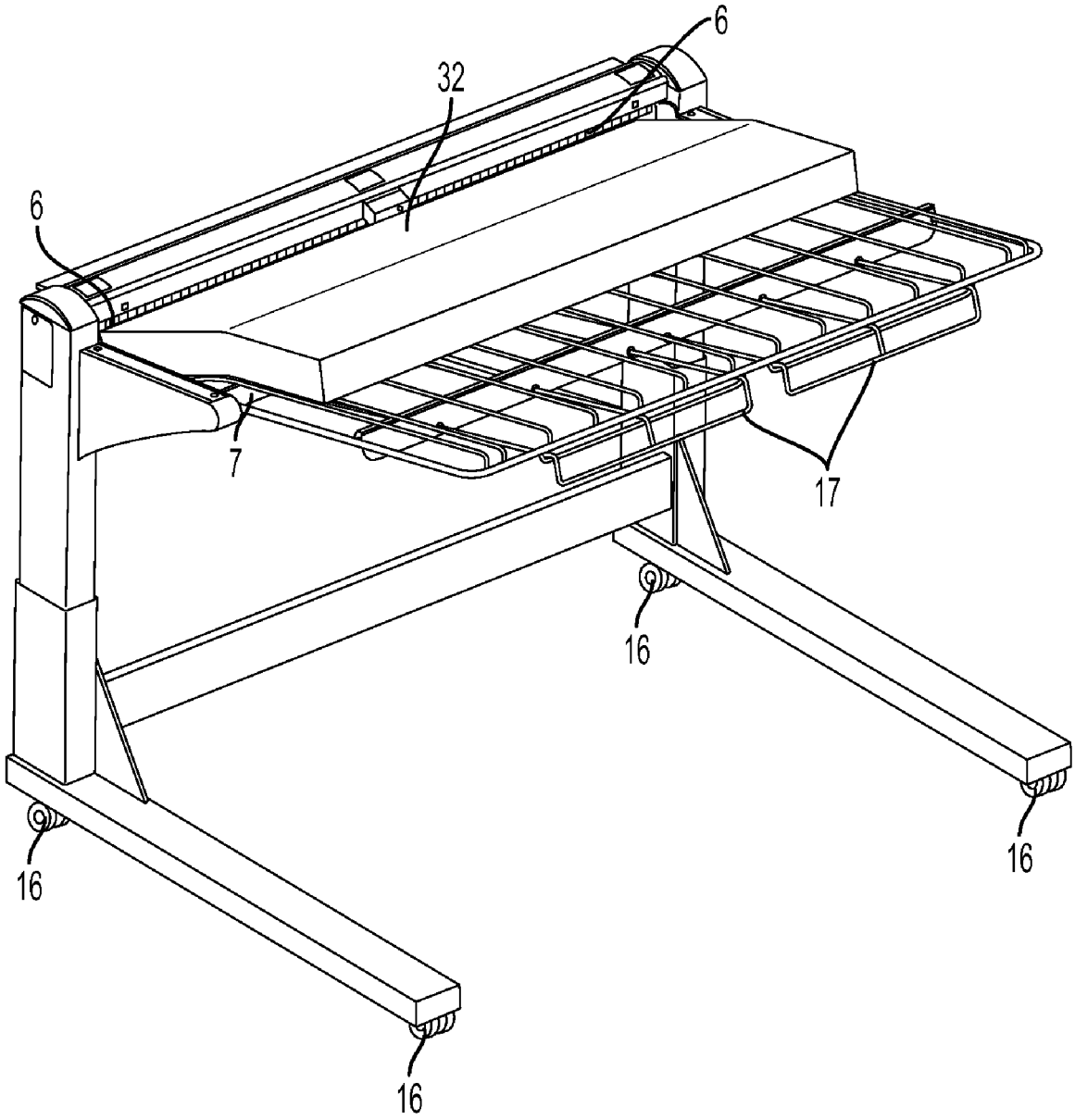
FIG. 10 is a perspective view of a movable embodiment of this invention as it collects and stacks a stack of 36" width paper.

In FIGS. 8, 9 and 10, perspective top views of the movably stacking tray 3 are shown with varying stacks of paper 4. FIG. 8 illustrates a stack of paper 4 having 8.5" widths. Note that springs 2.1 and 2.2 are depressed as they support the stack 30 of 8.5" width paper. FIG. 9 shows a stack 31 of 24" width paper; thus, springs 2.1-2.4 are depressed and in FIG. 10, springs 2.1-2.6 are all depressed since all springs support a paper stack 32 of 36" width paper.

In summary, this invention provides embodiments where a wide format paper stacker assembly is provided comprising an elongated paper entrance structure configured to receive different size paper, and a stacking tray (wire preferred) connected to said paper entrance structure. The preferred wire stacking tray has horizontally disposed from said paper entrance a plurality of wire paper supports. These paper supports have perpendicular disposed cross supports connecting the wire supports. One of the cross supports has attached at one portion thereto at least two springs or movable bands, these bands or springs are configured to flexibly support various size paper to be collected in the wire stacking tray. These movable bands or springs are configured to minimize paper curl in paper supported in said wire stacking tray. In a preferred embodiment from 2-6 of these movable bands or springs are disposed along a length of the cross support. These movable bands or springs are flexibly positioned and aligned above the wire stacking tray at a location adjacent to the paper entrance structure. The movable bands or springs, as noted, are positioned in alignment with each other and configured where a flexible section of the bands or springs are disposed in spaces between wires of the wire stacking tray. The bands or springs are configured to be flexible downwardly to a distance of approximately the depth of the wire stacking tray. A sensor is positioned near or at the paper entrance structure; this sensor is configured to measure the size and volume of paper entering the assembly. In the preferred embodiment having from 2 to 6 movable bands or springs, all of the bands or springs are configured to support wider paper, and wherein less than all of the bands or springs are configured to support narrower paper. All of the above summarized disclosure can be preferably used in an electrophotographic or xerographic marking system having the conventional stations, including a paper collection station using the paper stacker assembly of this invention. The paper stacking assembly of this invention will minimize paper curl, reduce jams in any finishing stations and significantly improve image quality.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A paper stacker assembly useful in an electrophotographic marking system comprising:

an elongated imaged paper entrance structure to receive different size image marked paper from an electrophotographic printer, a paper transporting structure that will transport paper after imaging from said printer to and out from said imaged paper entrance, a wire stacking tray connected to said imaged paper entrance structure, said wire stacking tray having a plurality of wire paper supports that are substantially horizontally disposed from said paper entrance, said paper supports having perpendicular disposed cross supports connecting said wire supports, said cross supports having attached at one portion thereof about 2 to 6 springs or movable bands, said springs or movable bands flexibly able to support paper to be collected in said wire stacking tray, and wherein all of said springs or movable bands support wider paper, and wherein less than all of said springs or movable bands support narrower paper, said springs or movable bands in alignment with each other and disposed in spaces between said wire paper supports, said springs or movable bands are flexible downwardly to a distance of a depth of said wire stacking tray, said springs or movable bands minimize paper curl in paper supported in said wire stacking tray.

2. The assembly of claim 1 wherein each spring or movable band is connected to and supported by a spring support at one end and extending to spring flexible ends at an opposite end portion where said paper enters the assembly, wherein each spring or movable band is connected to and supported by a spring support at one end and extending to spring flexible ends at an opposite end portion where said paper enters the assembly.

* * * * *